United States Patent [19]

Meiller

[11] Patent Number: 4,601,514

[45] Date of Patent: Jul. 22, 1986

[54] SEAT HAVING AN ADJUSTABLE BACK SUPPORT ARRANGEMENT

[75] Inventor: Hermann Meiller, Amberg, Fed. Rep. of Germany

[73] Assignee: Messrs. Willibald Grammer, Amberg, Fed. Rep. of Germany

[21] Appl. No.: 568,712

[22] Filed: Jan. 6, 1984

[30] Foreign Application Priority Data

Jul. 8, 1983 [DE] Fed. Rep. of Germany ..... 3324655

[51] Int. Cl.[4] ..... A47C 7/46

[52] U.S. Cl. ..... 297/284; 297/460

[58] Field of Search ..... 297/284, 452, 460, 458, 297/330; 128/377, 33, 48, 49

[56] References Cited

U.S. PATENT DOCUMENTS

| | | | |
|---|---|---|---|
| 2,053,852 | 9/1936 | Tracy | 297/330 X |
| 2,608,239 | 8/1952 | Gordon | 297/330 X |
| 2,756,809 | 7/1956 | Endresen | 297/284 |
| 2,942,651 | 6/1960 | Binding | 297/284 |
| 3,147,038 | 9/1964 | Barabas | 297/330 X |
| 3,288,525 | 11/1966 | Cerf | 297/460 X |
| 3,446,532 | 5/1969 | Cramer | 297/337 X |
| 3,565,482 | 2/1971 | Blodee | 297/284 |
| 3,628,528 | 12/1971 | Roberts | 128/33 X |
| 3,877,750 | 4/1975 | Scholpp | 297/284 |
| 4,153,293 | 5/1979 | Sheldon | 297/460 X |
| 4,316,631 | 2/1982 | Lenz et al. | 297/284 |
| 4,425,910 | 1/1984 | Meiller | 297/284 X |

FOREIGN PATENT DOCUMENTS

| | | | |
|---|---|---|---|
| 200748 | 5/1958 | Austria | 297/284 |
| 1169625 | 5/1964 | Fed. Rep. of Germany . | |
| 2804703 | 8/1979 | Fed. Rep. of Germany . | |

*Primary Examiner*—William E. Lyddane
*Assistant Examiner*—José V. Chen
*Attorney, Agent, or Firm*—Fleit, Jacobson, Cohn & Price

[57] ABSTRACT

The seat has a backrest with a back support integrated therein, comprising a curved spring plate member which bears against the rear of the backrest cushion. The distance, as measured in the heightwise direction of the backrest, between the upper and lower edges of the spring plate member can be adjusted by manual or motor-driven means to vary its curvature and the resistance to bending of the spring plate member is lower in its lower region than in its upper region whereby, when the distance between its upper and lower edges is progressively reduced, the spring plate member initially becomes more curved in its lower region until a restricting means comes into action to limit that initially produced increase in curvature, with the result that the curvature in the upper region is then increased.

12 Claims, 8 Drawing Figures

SEAT HAVING AN ADJUSTABLE BACK SUPPORT ARRANGEMENT

BACKGROUND OF THE INVENTION

The invention relates generally to a seat such as a seat for use in a motor vehicle, more specifically a seat which includes an adjustable back support arrangement.

Seats such as those fitted in motor vehicles are often provided with back support arrangements which are adjustable in respect of depth, that is to say, in the direction of the thickness of the upholstery of the backrest portion of the seat, while the position of the support effect, in respect of the height or generally vertical extent of the backrest portion of the seat, is fixed and predetermined. However, as will be readily appreciated, people do not all have the same kind of spinal column nor do they all have the same need for support at a given location. Thus, it may be found that support is required for the occupant of a seat, not only with a different depth or extent of forward projection of the support arrangement, but also at a different height, if the support arrangement is to provide the optimum form of support, from a medical point of view. In addition, even when considering one and the same type of spinal column, it is desirable to be able to alter the loading on the intervertebral discs in order to avoid permanently loading individual discs, with all the harmful consequences that that may entail.

The above-discussed problems are particularly important from the point of view of drivers of commercial vehicles who often have to spend for example up to eight hours per day, or even longer, in a sitting position.

Laid-open German application (DE-OS) No. 30 45 809 (U.S. Ser. No. 06/325,496 filed 11-27-81 now U.S. Pat. No. 4,425,910) to the present applicant discloses a seat having a backrest with an adjustable vertebral support, which is integrated in the backrest portion of the seat. That seat has two separate adjusting elements, in the form of curved spring plate members, which are adjustable in respect of the depth of the backrest cushion and which are disposed one above the other in the heightwise direction of the backrest. The two spring plate members which are actuable by a suitable actuating arrangement engage a common, curvable support plate which is disposed at the rear of the backrest cushion or upholstery. That seat and back support arrangement provides for adjustment both in respect to the depth of the backrest and also in respect to the heightwise direction of the backrest, by virtue of having the two separate spring plate members, with a suitable mechanism for separately curving the two spring plate members as required.

SUMMARY OF THE INVENTION

An object of the present invention is to provide a seat having a backrest with an adjustable vertebral support arrangement.

Another object of the present invention is to provide a seat with a backrest having a variable back support arrangement to permit ready adjustment of the support afforded to the spine of the occupant of the seat.

Still another object of the present invention is to provide a seat having a backrest with an integrated back support arrangement, which is made up of a small number of components and which is light in construction.

Yet another object of the present invention is to provide a seat backrest with integrated variable back support arrangement which can be adjusted to provide support for the back of the occupant of the seat at the optimum level.

A further object of the present invention is to provide a seat with an integrated back support arrangement in the backrest portion, with readily and easily controllable means for adjusting the effective support provided for the spine of the occupant of the seat.

A still further object of the present invention is to provide a seat with a back support arrangement integrated in the backrest portion of the seat, which can provide for a continuous massage effect for the back of the occupant of the seat.

These and other objects are achieved by a seat which includes a backrest portion with a backrest carrier structure and, integrated therein, an adjustable back support means in the form of a spring plate member which bears against a rearward part of the upholstery or cushion of the backrest portion, to move it into a configuration adapted as required by the occupant to provide suitable back support. The spring plate member is adjustable in respect of depth of the backrest portion, by being caused to adapt a configuration that is variably curved forwardly of the seat, means being provided for varying the distance, as measured in the heightwise direction of the backrest portion, between the upper and lower edge portions of the spring plate member, thereby to vary the curvature of the spring plate member. The spring plate member has a lower degree of resistance to bending in its lower region than in its upper region, so that its curvature initially increases in its lower region, and there is a means for restricting or limiting the degree of curvature of the spring plate member, in the lower region thereof; when said restricting means becomes operative to limit the degree of curvature of the lower region of the spring plate member, the upper region is caused to become more curved, thereby shifting the area of support for the back of the occupant of the seat, in an upward direction.

It will be seen therefore than the arrangement constructed in accordance with the principles of the present invention has the advantage that there is only one forwardly curved spring plate member which, by means of an easily manually operable device or by means of a suitable drive motor, is capable of producing virtually a vertical standing oscillatory motion, in respect of the depth of the backrest portion of the seat, simply by the spring plate member being so-to-speak upset to a greater or lesser degree in the heightwise direction thereof. As will be seen hereinafter, the means provided to displace the spring plate member in the above-indicated manner can be of a very simple design configuration.

The purpose of the spring plate member having a lower degree of bending stiffness in its lower region than in its upper region is to ensure that, when the distance between its upper and lower edges is reduced, the spring plate member is firstly curved forwardly of the seat beyond its normal curved configuration, in the lower portion of the spring plate member. When the spring plate member is in the configuration of having a greater degree of curvature in its lower portion, it will thus project further forwardly of the seat then in its normal state, thereby providing for increased support for the lower back part of the occupant of the seat. One way of achieving the lower degree of bending stiffness in the lower region of the spring plate member is for the spring plate member to be narrower in its lower region than in its upper region.

Another way of achieving the same effect is for the spring plate member to have slots or openings in its lower region. Yet another way to provide a lower degree of bending stiffness in the lower portion of the spring plate member is for a further plate member to be secured to the spring plate member in the upper region thereof, thereby increasing its resistance to bending in that region.

In order to restrict or limit the curvature of the spring plate member, which is produced in the lower region thereof, an advantageous embodiment of the arrangement according to the invention provides that a substantially flat plate member is secured to the spring plate member in its lower region, the flat plate member being disposed at a spacing from the curved spring plate member. Alternatively, projections or bars or lugs may be provided at the lower edge part in the lower portion of the spring plate member, such projections or the like facing inwardly of the curvature defined by the curved configuration of the spring plate member. The arrangement is such that, when the curvature of the spring plate member is increased to a certain degree in its lower portion, the projecitons come into mutual contact with each other, thereby to restrict or limit further curvature of the spring plate member in its lower region. The projections or the like may be for example of a generally trapezoidal cross-section, to provide the curvature-limiting effect.

As will be seen in greater detail from the preferred embodiments hereinafter, by virtue of the arrangements briefly defined in the foregoing, when the spring plate member is in a non-loaded condition, that is to say, when the distance as measured in the heightwise direction of the backrest portion between the upper and lower edges of the spring plate member has not been reduced in relation to its normal value, the maximum point of curvature of the spring plate member is disposed approximately in the central portion of the spring plate member, in the heightwise direction thereof. When the distance between the upper and lower edges of the spring plate member is initially reduced, the maximum point of curvature of the spring plate member is initially displaced into the lower portion thereof, being the portion which has a lower degree of resistance to bending, so that the spring plate member provides increased support in the lower part of the back of the occupant of the seat. As the distance between the upper and lower edges of the spring plate member is increasingly reduced, by virtue of the action of the means for limiting or restricting the degree of curvature of the spring plate member in the lower region thereof, the point of maximum curvature of the spring plate member is moved into the upper region of the spring plate member, thus also displacing the main area of vertebral support of the backrest support arrangement. Thus, by virtue of the back support arrangement having a means for compressing or releasing the spring plate member only in a substantially vertical direction, that is to say, in the heightwise direction of the backrest portion of the seat, the curvature of the spring plate member can be located either in its lower region or in its upper region or in a central region; in a preferred form of the arrangement, a motor may be provided to produce a cyclic variation in the location of the curvature of the spring plate member, thus providing a massage effect for the spinal column of the occupant of the seat.

In a particularly simple form of the arrangement in accordance with the principles of this invention, the upper edge of the forwardly curved spring plate member is support by a suitable support means such as a plate member of angular configuration, which is secured to the backrest carrier structure or frame, while the lower edge of the spring plate member, which preferably extends at least substantially parallel to the upper edge, is carried by a vertically displaceable support means, including a similar angle member to that which supports the upper edge. In that arrangement, the means for varying the distance between the upper and lower edges of the spring plate member, being combined with the support member for supporting the lower edge of the spring plate member, may comprise an angled lever, for example a lever of substantially L-shaped configuration, which is manually operable from outside the backrest of the seat. The lever can be reversibly pivoted by means of a spindle having an actuating wheel outside the backrest, thereby to produce reversible vertical loading of the spring plate member, to cause it to assume a correspondingly curved configuration. With that arrangement, it is readily possible manually to set or alter a desired position for the vertebral support arrangement.

In another advantageous and preferred embodiment of the seat according to the invention, the means for varying the distance between the upper and lower edges of the curved spring plate member, being combined with the member for supporting the lower edge thereof, comprises a vertically guided eccentric which can be driven by a motor such as an electric motor by way of a suitable gear transmission. Thus, when the motor is switched on, a rhythmic and cyclic variation in the curvature of the spring plate member may be produced by the action of the eccentric thereon, to produce a motion in the nature of a standing wave, as referred to hereinbefore. This arrangement also has the advantage that there is no need to reverse the direction of rotation of the motor, for the purposes of adjusting the location of curvature of the spring plate member, but instead the motor can always rotate in the same direction. The motor may also be controlled by means of a suitable control arrangement such as an electrical throttling circuit in such a way that the occupant of the seat no longer perceives or feels the continuous rhythmic change in curvature of the spring plate member and thus the vertical cyclic massage effect. In that case therefore, the curvature of the spinal column of the occupant is being constantly altered, but without the person truly being aware thereof, thus having the effect that the musculature of the person in the seat is subjected to cyclically fluctuating loadings so that in particular the supply of blood to the musculature around the spinal column is improved by the stress-relief effect produced as a result.

In order for the maximum of curvature of the spring plate member, when it is subjected to a loading in the heightwise direction, to be formed laterally beside a defined nodal point, in other words, in order to produce precisely defined conditions in respect of the configuration of the support arrangement, with very simple means, the curvature limiting element is advantageously connected to the backrest portion support structure or frame, substantially at the centre of the curved spring plate member. It has a screw member which is held in a cage. The limiting screw member which is displaceable axially by a given distance bears rigidly or tautly against the spring plate member when the maximum point of curvature of the spring plate member is in the lower portion thereof, during the first phase of the reduction in the distance between the upper and lower edges of the spring plate member. When that distance is still further reduced, the curvature limiting element prevents or impedes further curvature in the lower region, and the area of maximum curvature is thus shifted into the upper portion of the spring plate member.

Further objects, features and advantages of the present invention will be apparent from the following preferred embodiments of the invention, described with reference to the accompanying drawings.

DESCRIPTION OF THE PREFERRED EMBODIMENTS

Figure 1:
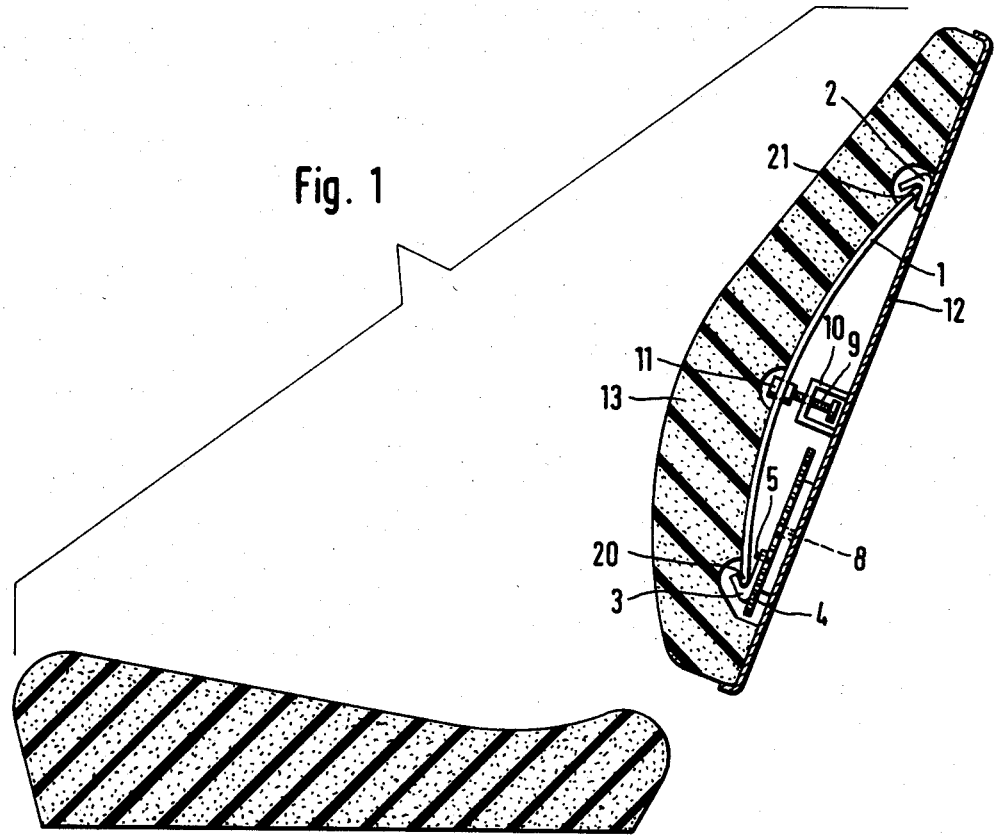
FIG. 1 shows a view in section through a seat comprising a seat base portion and a backrest portion, with a vertebral or spinal support arrangement.

Reference will first be made to FIG. 1 showing a view in section, in diagrammatic form, through a seat such as a seat for use in a motor vehicle, comprising a seat base portion and a seat backrest portion which is illustrated as being lifted away from the seat base portion. The backrest portion comprises a backrest carrier structure or frame arrangement diagrammatically indicated at 12, to which a first support member 2 in the form of a plate member of an angled configuration is secured. Also carried on the backrest structure 12 is another support member 3 in the form of a further angled plate member which is mounted for displacement in a vertical direction, that is to say, in the heightwise direction of the backrest portion. A spring plate member 1 forming a back support arrangement is disposed between the rigid support member 2 and the vertically displaceable support member 3, with the lower and upper edges 20 and 21 respectively of the spring plate member being engaged with the support members 3 and 2 respectively. A screw member 9 is disposed with its head portion 11 at the centre of the spring plate member 1, being carried for limited mobility in a cage 10 secured to the backrest structure 12. The purpose of the screw 10 is to limit or restrict the extent of curvature of the spring plate member 1, as will be apparent hereinafter. A backrest upholstery portion or cushion 13 which is matched to the respective configuration of the spring plate member 1 covers the spring plate member 1 and the backrest portion support structure 12.

For the purposes of varying the location and the amplitude of the maximum curvature of the spring plate member 1, it is only necessary to vary the clamping width of the spring plate member 1 between its two edges 20 and 21, that is to say, the distance between the support members 2 and 3. Such adjustment can be provided by virtue of the support member 3 being displaced vertically upwardly. That displacement, towards the rigidly mounted support member 2, is effected by means of an eccentric 5 pivotably supporting a support member 3. A gear wheel 4 is rotatable about an axis 8. The gear wheel 4 can be driven in rotation by a motor (indicated at 7 in FIG. 3), by way of a pinion which is indicated at 6 in FIG. 3. During one turn of the gear wheel 4 the eccentric 5 makes also one turn and simultaneously the support member 2 moves for varying the distance as measured in the heightwise direction of the backrest portion, thereby to vary the curvature of the spring plate member 1.

Reference will now be made to FIG. 2 which shows the three possible stable positions of curvature of the spring plate member which is gripped between the upper rigid support member 2 and the lower movable support member 3. The backrest upholstery or cushion 13 matches the respective configuration of the spring plate member 1, in the various positions thereof.

Figure 2A:
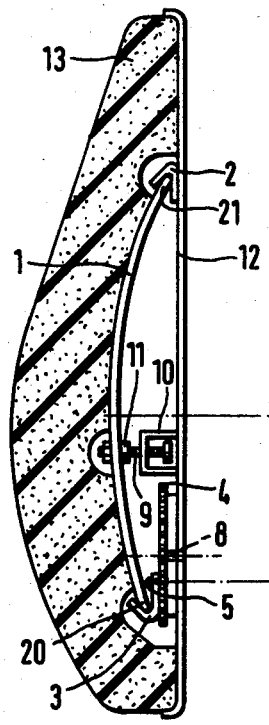
FIG. 2 shows a backrest portion in the three possible stable positions of the back support arrangement in the form of a spring plate member.

In the position shown in FIG. 2*a*, the distance between the upper and lower edges of the forwardly curved spring plate member 1 is at its largest, that is to say, the spring plate member 1 is in a non-loaded condition by virtue of the eccentric 5 being at the lowest point, according to the position of the gear wheel 4 which is rotatable about the axis 8. In that virtually non-loaded condition, the point of maximum curvature of the spring plate member 1 is at the centre thereof, while the screw member 9 which has its head 11 bearing against the spring plate member 1 is disposed loosely in the cage 10 secured to the support structure 12.

Figure 2B:
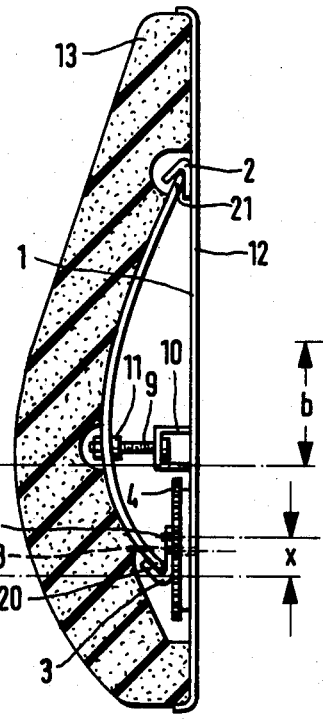

When the gear wheel 4 rotates further about the axis 8 so that the eccentric 5 is displaced vertically upwardly by the distance X, into the curvature position shown in FIG. 2*b*, then at the same time the lower support member 3 which is pivotably connected to the eccentric 5 is also displaced vertically by the same distance X and the distance between the edges 20 and 21 of the spring plate member 1 is reduced by the same distance X. Because the spring plate member 1 has a lower degree of resistance to bending in its lower region than in its upper region, the reduction in the distance between the upper and lower edges of the spring plate member 1, which is therefore equivalent to upsetting of the spring plate member 1 in the heightwise direction of the backrest portion, causes the point of maximum curvature of the spring plate member 1 to be displaced downwardly by a distance indicated at a. In that second, stable position of the spring plate member 1, the screw 9 takes up a position of abutment in the cage 10, so that the curvature of the spring plate member 1 is fixed both in its vertical amplitude and also in its horizontal amplitude. In this second position of curvature of the spring plate 1, therefore, an upwardly directed, vertical upsetting loading of the spring plate member 1 by a distance X causes the point of maximum curvature of the spring plate member to be displaced downwardly by a distance a.

Figure 2C:
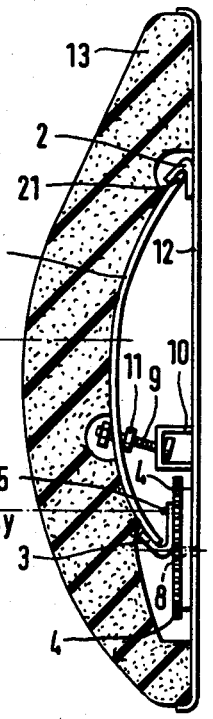

In the third position of curvature as shown in FIG. 2*c*, the eccentric 5 has reached its uppermost position, by virtue of rotation of the gear wheel 4 about its axis 8; the eccentric 5 and therewith the lower support member 3 moves further upwardly by the distance indicated by y in FIG. 2*c*. In that position, the distance between the edge 21 of the spring plate member, which bears against the upper support member 2, and the lower edge 20 of the spring plate member, which bears against the lower support member 3, is at its smallest, that is to say, the spring plate member 1 is subjected to the maximum upsetting loading. Because the limiting screw member 9 is already rigidly or tautly stressed in the position shown in FIG. 2*b*, the maximum admissible curvature is already reached in the lower region of the spring plate member 1, and the maximum vertical upsetting loading of the spring plate member can only be compensated for, by the point of maximum curvature of the spring plate member 1 being displaced by a distance b into the upper region of the spring plate member 1, in which case the screw 9 bears tautly and fixedly against the cage 10.

When the gear wheel 4 continues to rotate in the same direction, then the position shown in FIG. 2*c* is cyclically followed by the position shown in FIG. 2*b* and the position shown in FIG. 2*a*, and so on.

Accordingly, with the seat in accordance with the present invention, with a back support arrangement, it is possible for the spring plate member to be caused to curve outwardly in respect of the depth of the upholstery or cushion 13 of the backrest portion, that is to say, in a substantially horizontal direction when the backrest portion is in a substantially vertical position, in two regions of the spring plate member 1 which are disposed vertically one above the other, besides being curved also in its central region, simply by a vertical upsetting action on the spring plate member 1; the upsetting effect and thus the curving action in respect of the spring plate member 1 can be effected permanently and without a change in the direction of rotation of the actuating arrangement, for example by means of an electric motor. The motor can be subjected to speed control or throttled by a suitable electrical control means, in such a way that for example it has a speed reduction of 1:100. The motor then rotates so slowly that the continuous displacement or adjustment of the back support arrangement, that is to say, the movements of the spring plate member 1 whereby it takes up different curvatures at different levels, are no longer perceived at all by the occupant of the seat. Accordingly, the person occupying the seat when operating in that condition constantly experiences changes in the curvature of his spine, but without perceiving that. However, that massage action has the effect that parts of the musculature of the occupant of the seat which are subjected to a loading are repeatedly relieved of load and the supply of blood to the musculature in the area of the spinal column is improved by the load relief action.

Figure 3:
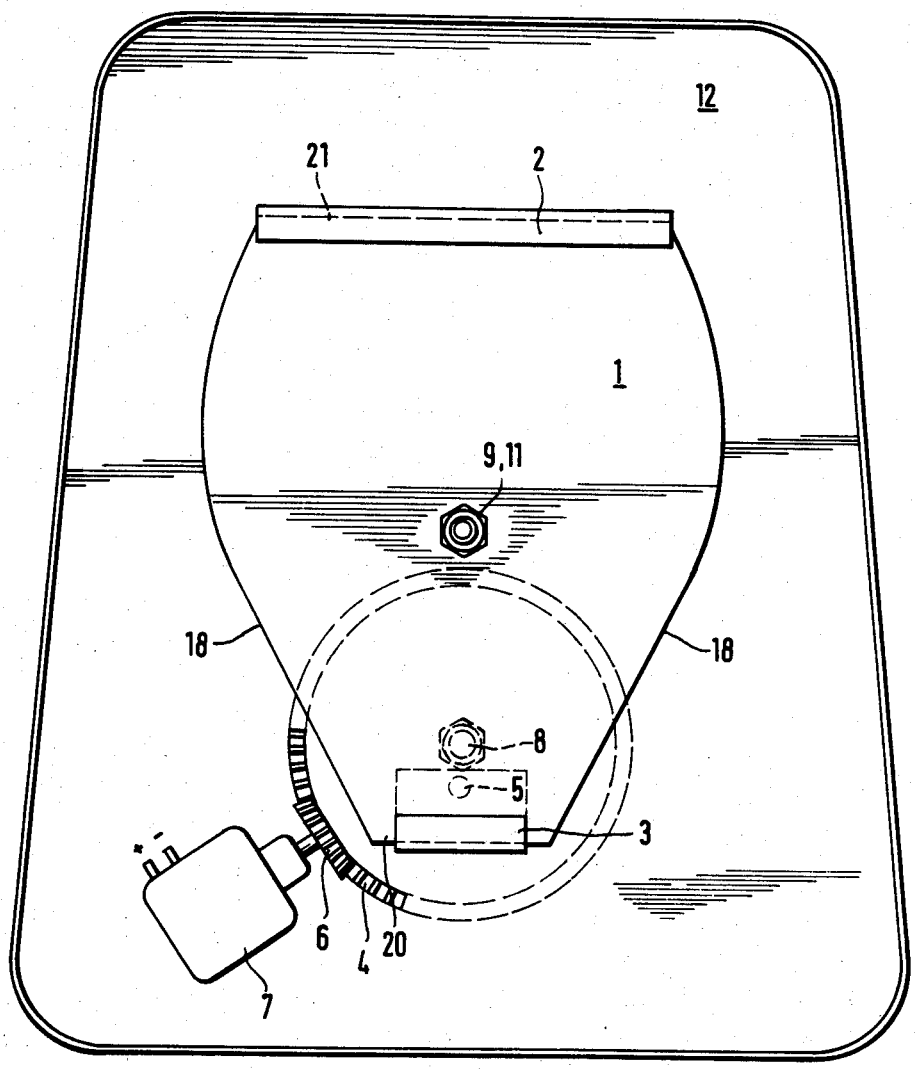
FIG. 3 shows a front view of a backrest portion as shown in FIG. 2.

FIG. 3 shows a front view of a backrest portion, without the upholstery cushion thereon. The upper support member 2 in the form of an angled member made for example of sheet metal is secured to the backrest support structure 12. FIG. 3 also shows the curvature-limiting screw member 9 which is displaceable in its central cage, and the gear wheel 4 which is rotatable about an axis 8.

The lower support member 3 in the form of an angle member similar to the member 2 is pivotably connected to the eccentric 5 so that when the gear wheel 4 rotates, the eccentric 5 and therewith the support member 3 are moved up and down, that is to say, in the heightwise direction of the backrest portion of the seat.

The gear wheel 4 is driven by means of a motor 7, by way of the pinion 6. The rotary movement of the gear wheel 4 is converted by means of the eccentric 5 into a cyclically repeated reduction in and increase in the distance between the edges 20 and 21 of the spring plate member 1; by virtue of the specific, generally trapezoidal outline configuration 18 of the spring plate member 1 in the lower region thereof, the stiffness in respect of bending of the spring plate member 1 in its lower region is less than in the upper region, which is above the screw member 9, thereby producing the variation in curvature as described above with reference to FIG. 2, in which the spring plate member goes through positions (a), (b), (c), (b), (a), (b) and so on in a continuous cycle.

Figure 4:
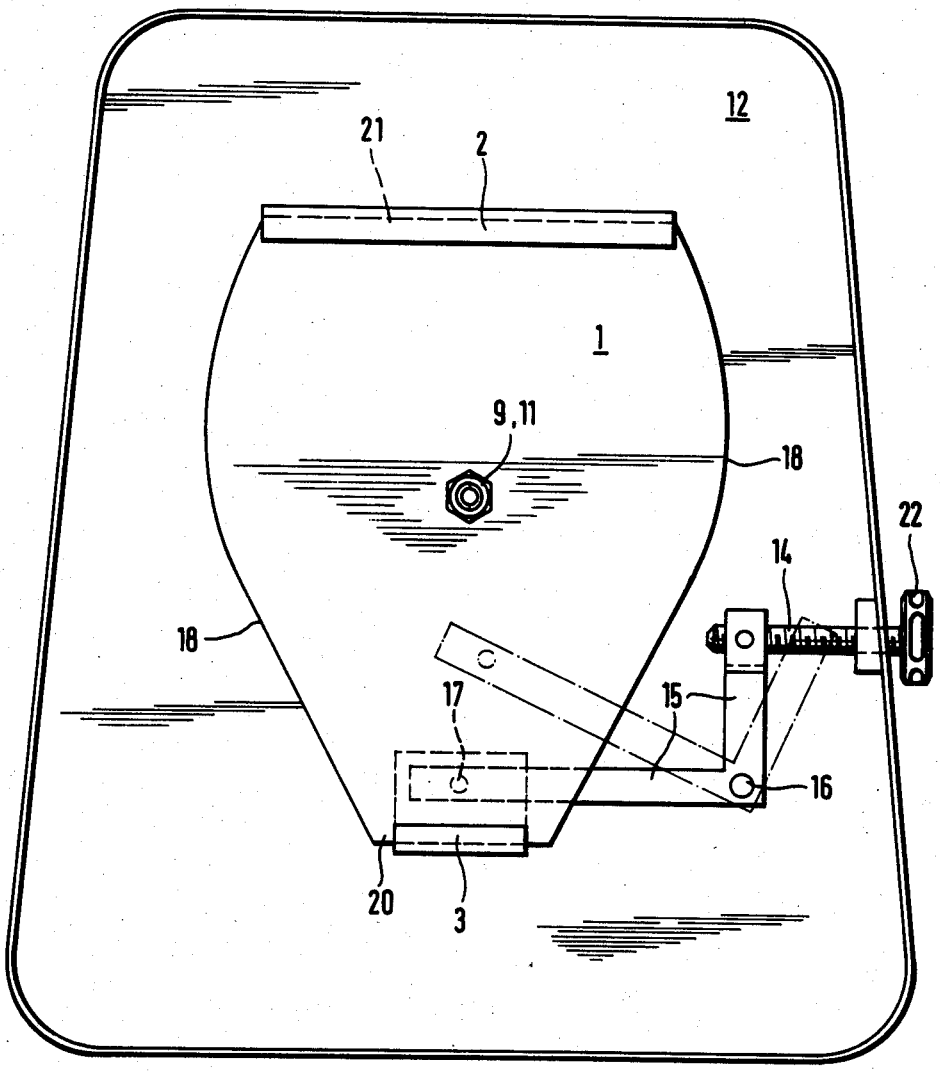
FIG. 4 shows a front view of a backrest portion, having a manually actuable means for varying the distance between the upper and lower edge portions of the spring plate member.

Reference will now be made to FIG. 4 which shows an embodiment of the seat backrest portion with back support arrangement in accordance with the present invention, which is generally similar to the construction described above with reference to FIGS. 1 through 3. The similarity between the structural designs shown in FIG. 3 and FIG. 4 respectively will be immediately apparent. In the FIG. 4 embodiment however, instead of the motor-driven adjusting means for the spring plate member 1, the spring plate member is adjustable by a manually operable control arrangement. More specifically, the control arrangement comprises a rotary handle or wheel 22 which is disposed outside the backrest portion of the seat and which is connected to a screwthreaded spindle 14, to produce rotary movement thereof in the appropriate direction as required. The screwthreaded spindle 14 engages an angle lever 15 which is mounted for pivotal movement about a pivot mounting arrangement diagrammatically indicated at 16. The lower support member 3 for supporting the lower edge of the spring plate member 1, being in the form of a sheet metal angle member, is carried on the free end portion of the longer arm of the lever 15, on a pin or trunnion member 17, for pivotal movement thereabout. Rotating the control wheel 22 and thus the spindle 14 in a given direction causes the lever 15 to pivot into the position shown in broken lines, which corresponds to a reduction in the distance between the upper edge 21 and the lower edge 20 of the spring plate member 1 which, as mentioned above, is of a similar configuration to the spring plate member shown in FIG. 3, being of a generally trapezoidal configuration as indicated by reference numeral 18. As in the FIG. 3 construction, the upper edge 21 of the spring plate member 1 is fixed in a support member 2 in the form of an angle member, which is secured to the carrier structure 12 of the backrest portion of the seat so that, when the heightwise distance between the edges 20 and 21 of the spring plate member 1 is reduced by actuation of the control mechanism 22, 14, 15 and 3, and due to the limitation action performed by the assembly 9 and 11 which restricts the cruvature that can be assumed at the location thereof, by the spring plate member 1, the spring plate member 1 goes through a curvature cycle as described above with reference to FIG. 2, passing in succession through positions (a), (b), (c), (b), (a), (b), (c), (b) and so on.

An important consideration in producing the above-described cycle or succession of curvature positions for the spring plate 1 is that the resistance or stiffness in respect of bending of the spring plate member is different, in two portions of the spring plate member which are disposed one above the other. As indicated above, the resistance to bending of the lower portion of the spring plate member 1 is less than that of the upper portion. In the embodiments shown in FIG. 3 and FIG. 4, that difference in bending strength is achieved by virtue of the generally trapezoidal configuration, which is narrower in the lower region, of the spring plate member. The same effect can also be achieved by the provision of one or more slots or openings in the lower region of the spring plate member, or by strengthening the upper region of the spring plate member, as for example by means of a further plate member which is secured to the spring plate member 1 in the upper region thereof. It will be appreciated that the above-listed possible ways of producing the variation in bending strength in the spring plate member 1 may be used individually or in any appropriate combination.

Figure 5:
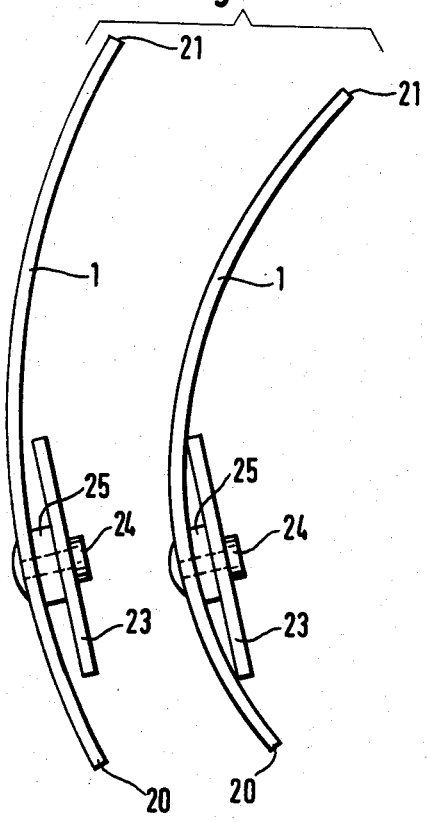
FIG. 5 shows a forwardly curved spring plate member with a separate flat plate mounted therebehind, in two different curved positions.

Reference will now be made to FIG. 5 which shows side views of the spring plate member 1 and a stiffening plate member which is secured to the rear side of the spring plate member 1, illustrating the arrangement in two different positions. The left-hand view in FIG. 5 shows the spring plate member 1 which is curved forwardly with respect to the seat and which is of a generally downward tapering, substantially trapezoidal configuration, as shown for example in FIG. 3 or FIG. 4. The spring plate member 1 is virtually non-loaded, as between its upper edge and its lower edge 20, that is to say, the spring plate member 1 is in a rest condition in which the distance between its upper and lower edges has not been reduced by a suitable actuating means, as described above. A flat stiff plate member 23 is secured to the spring plate member 1 at the rear thereof, in its lower portion, as for example by means of a rivet 24. A spacer member or disc 25 is interposed between the spring plate member 1 and the plate member 23, to define a given distance therebetween. The right-hand side of FIG. 5 shows the same arrangement, but in the condition in which the distance between the edges 20 and 21 of the spring plate member 1 has been reduced, by upsetting or compressing the spring plate member 1 in the heightwise direction. With the illustrated construction, the spring plate 1 may be curved in its lower portion only until the straight or flat plate member 23 comes to bear against the concave rear surface of the spring plate member 1, that is to say, it is in the relationship of a chord thereto. That limits or restricts the maximum degree of curvature of the lower portion of the spring plate member 1 so that, if the actuating mechanism continues to operate to further reduce the distance between the upper and lower edges 21 and 20 of the spring plate member 1, the curvature thereof moves upwardly of the spring plate member, as illustrated for example in FIG. 2*c*.

Figure 6:
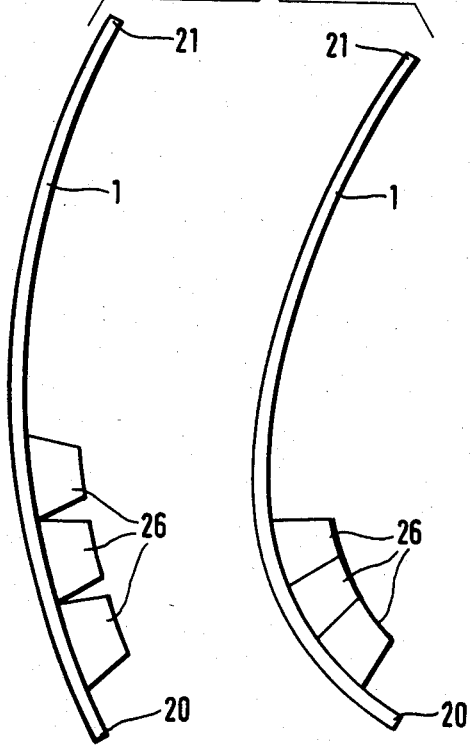
FIG. 6 shows a forwardly curved spring plate member with projections or lugs which project inwardly of the curvature of the spring plate member, in two different positions of curvature.

FIG. 6 shows views similar to those shown in FIG. 5, of a modified embodiment of the spring plate member 1, with curvature-restricting means thereon. In the view shown on the left-hand side of FIG. 6, the spring plate member 1 which is curved forwardly and which is for example of a downwardly tapering, generally trapezoidal configuration similar to that shown in FIG. 3, is in a generally rest condition, being virtually uncompressed, as between its upper edge 21 and its lower edge 20. It will be seen that projections or lugs 26 which are each of a generally trapezoidal cross-section are formed on the back of the spring plate member 1 in the lower portion thereof, for example at the side edges or in some other suitable location. The projections 26 may be bent out directly from the spring plate member 1 or they may be subsequently fitted thereto. The right-hand view in FIG. 6 shows the same assembly but in the condition in which the edges 21 and 22 have been loaded towards each other in the heightwise direction of the backrest portion of the seat. In this embodiment, the spring plate member 1 can be curved further only until the side surfaces of the trapezoidal projections 26 butt against each other. If the edges 20 and 21 of the spring plate member 1 are urged towards each other even further by actuation of the operating mechanism, then the increasing curvature of the spring plate member 1 moves into the upper region thereof, thus resulting in the sequence of curvature movements described with reference to FIG. 2 above. It will be appreciated that other forms of projections may be provided, in place of the projections 26 shown in FIG. 6.

In another modified embodiment, the lower degree of resistance to bending of the lower portion of the spring plate member may be achieved by stiffening the upper region, as by securing a further plate member to the spring plate member in the upper region thereof.

It will be appreciated that the above-described constructions are given only by way of example and illustration of the present invention, and various modifications and alterations may be made without thereby departing from the spirit and scope of the present invention.

I claim:

1. A seat including a backrest, said backrest including a backrest carrier structure, upholstery means mounted on said backrest carrier structure, and a vertebral support arrangement mounted on said backrest carrier structure and supporting said upholstery means, said vertebral support arrangement comprising:

a spring plate member curved forwardly with respect to the seat, said spring plate member bearing against the upholstery means to support said upholstery means forwardly, the spring plate member having a first edge portion defining an upper edge portion in relation to the backrest and a second edge portion defining a lower edge portion, and the spring plate member including a lower region and an upper region, said lower region having a lower resistance to bending than said upper region so that curvature initially increases in said lower region;

curving means located between said backrest carrier structure and said spring plate member and mounted on said spring plate member for varying the distance between the first edge portion and the second edge portions of the spring plate member to vary the curvature of said spring plate member; and curvature restricting means located between said backrest carrier and said spring plate member for restricting an increase in the degree of curvature of the spring plate member in said lower region when said curving means decreases the distance between said first and second edge portions a predetermined distance, a further decrease in the distance between said first and second edge portions beyond said predetermined distance causes a maximum point of curvature of said spring plate member to jump from said lower region to said upper region, said upper region thereby becoming curved to shift an area of support for the back of an occupant of said seat in an upward direction.

2. A seat as set forth in claim 1 wherein said spring plate member is narrower in its lower region than in its upper region to provide said lower resistance to bending.

3. A seat as set forth in claim 1 wherein said curvature restricting means includes an at least substantially flat plate member secured to the spring plate member in the lower region thereof and disposed at a spacing from the spring plate member and said at least substantially flat plate contacting said spring plate member when said spring plate member reaches a given degree of curvature.

4. A seat as set forth in claim 1 wherein said curvature restricting means comprises a plurality of projections on the rearward surface of said spring plate member at the edge of the lower region thereof and said plurality of projections butting against each other when the spring plate member reaches a given degree of curvature.

5. A seat as set forth in claim 1 wherein said curvature restricting means comprises a restricting element disposed substantially centrally of the spring plate member and connected to the spring plate member and to the backrest carrier structure.

6. A seat as set forth in claim 1 wherein said support arrangement further comprises a first bearing member fixed with respect to the backrest carrier structure for supporting one of said edge portions of said spring plate member, and a second bearing member for supporting the other edge portion of said spring plate member, said second bearing member being displaceable in the heightwise direction of the backrest.

7. A seat as set forth in claim 6 wherein said first bearing member supports said first edge portion.

8. A seat as set forth in claim 6 and further comprising an actuating means actuable from outside the backrest for varying the position of said second bearing member.

9. A seat as set forth in claim 8 wherein said actuating means comprises an eccentric means operatively connected to said second bearing member, means for guiding said second bearing member in the heightwise direction of the backrest, a drive motor, and a transmission means for transmitting the drive of the drive motor to said eccentric means to vary the distance between said first and second bearing members.

10. A seat as set forth in claim 9 wherein said actuating means is operable to provide continuous displacement of said second support member in the heightwise direction of the backrest.

11. A seat including a backrest, said backrest including a backrest carrier structure, an upholstery cushion means thereon, and a vertebral support adjusting means, said vertebral support adjusting means comprising:

a spring plate member located between said backrest carrier structure and said upholstery means and said spring plate member acting against said upholstery means to displace an adjoining portion of said upholstery means relative to said backrest carrier structure to vary the distance of an outward surface of said upholstery means from said backrest carrier structure, said spring plate member having a first edge portion defining an upper edge thereof in relation to the backrest in its position of seating installation and a second edge portion defining a lower edge thereof, a first region of said spring plate member located adjacent to said lower edge and extending towards said upper edge has a lower resistance to bending than a second region of said spring plate member located adjacent to said upper edge and extending towards said lower edge, curving means located between said backrest carrier structure and said spring plate member for varying the distance between said upper edge and said lower edge of the spring plate member to vary the curvature of said spring plate member with said spring plate member initially curving to a greater degree in said first region than in said second region by virtue of the difference in the resistance to bending thereof in the respective ones of said first and second regions, and means for restricting the degree of curvature of the spring plate member in said first region, after the spring plate member reaches a predetermined degree of curvature, so that upon a further reduction in said distance between said upper and lower edges of said spring plate member by said curving means, the curvature of the spring plate member in said second region is increased.

12. A seat as set forth in claim 11 wherein said lower resistance to bending in said first region of said spring plate member includes a downwardly inwardly tapering configuration of said spring plate member.

* * * * *